US005284437A

United States Patent [19]

Aigner

[11] Patent Number: 5,284,437

[45] Date of Patent: Feb. 8, 1994

[54] METHOD OF MINIMIZING THE $NO_x$ EMISSIONS FROM A COMBUSTION

[75] Inventor: Manfred Aigner, Wettingen, Switzerland

[73] Assignee: Asea Brown Boveri AG, Baden, Switzerland

[21] Appl. No.: 782,326

[22] Filed: Oct. 24, 1991

[30] Foreign Application Priority Data

Nov. 2, 1990 [CH] Switzerland ..... 3487/90

[51] Int. Cl.[5] ..... F23J 7/00

[52] U.S. Cl. ..... 431/4; 431/190; 431/351

[58] Field of Search ..... 431/4, 350, 353, 351, 431/354, 190

[56] References Cited

U.S. PATENT DOCUMENTS

| | | | |
|---|---|---|---|
| 3,021,673 | 2/1962 | Mock . | |
| 3,748,080 | 7/1973 | Donn | 431/4 |
| 3,797,992 | 3/1974 | Straitz, III | 431/4 X |
| 3,861,857 | 1/1975 | Straitz | 431/4 X |
| 4,932,861 | 6/1990 | Keller et al. . | |
| 5,044,935 | 9/1991 | Peter . | |

FOREIGN PATENT DOCUMENTS

| | | | |
|---|---|---|---|
| 0007697 | 2/1980 | European Pat. Off. . | |
| 0321809 | 6/1989 | European Pat. Off. . | |
| 2289849 | 5/1976 | France | 431/4 |
| 1400549 | 7/1975 | United Kingdom . | |
| 2050592 | 1/1981 | United Kingdom . | |

OTHER PUBLICATIONS

"Gas Turbine Combustion", A. H. Lefebvre, Hemisphere Publishing, McGraw-Hill, pp. 484–487.

Jap. Abstract, vol. 3, No. 84, Jul. 1979–"Burner Equipment".

Jap. Abstract, vol. 4, No. 143, Oct. 1980–"Combustor".

*Primary Examiner*—Carl D. Price

*Attorney, Agent, or Firm*—Burns, Doane, Swecker & Mathis

[57] ABSTRACT

To minimize the $NO_x$ emissions by means of water in the combustion of a fuel, without incurring the risk of higher CO emissions arising instead, the sensitive ignition zones of a burner (A) are penetrated by compact water jets (11) (solid jets) at the point where a freshly fed fuel/air mixture is continuously ignited anew, in such a way that these zones are not disturbed. In this way, instabilities, flame pulsations and/or poor burnout, which are responsible for a rapid increase in CO emissions during combustion, are prevented. In the interior of the flame, the water jets (11) then burst open and the water is distributed exactly where it counteracts the $NO_x$ emissions.

9 Claims, 3 Drawing Sheets

METHOD OF MINIMIZING THE $NO_x$ EMISSIONS FROM A COMBUSTION

BACKGROUND OF THE INVENTION

1. Field of the Invention

The present invention relates to a method of minimizing $NO_x$ emissions in the combustion of a fuel in a furnace installation fitted with at least one burner. It also relates to a burner for carrying out the method.

2. Discussion of Background

In the combustion of oil, gas and other fuels of high calorific value, the waste gas compositions are subject to increasingly stringent statutory regulations with respect to the pollutants formed. Thus, for example, in the operation of a gas turbine, above all the adherence to the regulations concerning the maximum permissible $NO_x$ emissions causes great difficulties. To adhere to these nitrogen emissions, it is usual to spray water into the flame in the combustion of the said fuels of high calorific value, with the final purpose of thus reducing the nitrogen oxide emissions. By means of this water feed, the hot zones in the flame are cooled, in such a way that the $NO_x$ production, which is extremely dependent on the maximum temperature which is reached, can be reduced in this way. In this connection, attention is drawn to the literature reference by Arthur H. Lefebvre, Gas Turbine Combustion, McGraw-Hill Series in Energy, Combustion and Environment, New York, pages 484 et seq. A problem in this method is the fact that the water fed frequently also interferes with flame zones which by themselves produce little $NO_x$ but are eminently important to the flame stability. Thus, large areas of the ignition zone, where freshly fed fuel/air mixture must continuously be ignited anew, are quenched by the conventional fine atomization of water which is also recommended by Lefebvre. As a consequence thereof, instabilities occur, such as flame pulsations and/or poorer, for example streaky burning in the combustion process, the effects of which are responsible for a rapid increase in the CO output.

SUMMARY OF THE INVENTION

Accordingly, the object of the invention as defined in the claims is, in a method of the type described at the outset, to feed the water to the combustion in such a way that the $NO_x$ emissions are thereby minimized, but without causing adverse effects on the combustion in the direction of an increase in the CO emissions and other pollutants.

The concept of the invention now comprises precisely not finely distributing the water right from the start, but passing it in the form of one or even a plurality of compact jets through the sensitive ignition zone already mentioned above, where a freshly fed fuel/air mixture is continuously ignited anew. Only a very small region is perturbed in each case by these so-called "solid jets", and this has virtually no effect on the combustion. In the interior of the flame, the jet or jets then burst open and the water is dispersed. These steps are assisted by:

a) the selection of a nozzle whose water jet bursts open after the desired length of travel;

b) high turbulence and heat supply within the flame core, which destabilize the water jet.

A further advantage of the invention is that, if these solid jets are used, splashing of the water onto the walls in narrow burners or combustion chambers is avoided, since otherwise the desired reduction in the $NO_x$ formation from the combustion process would not take place.

Advantageous and appropriate further developments of the achievement of the object according to the invention are defined in the dependent patent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS AND COMMERCIAL APPLICABILITY

Figure 1:
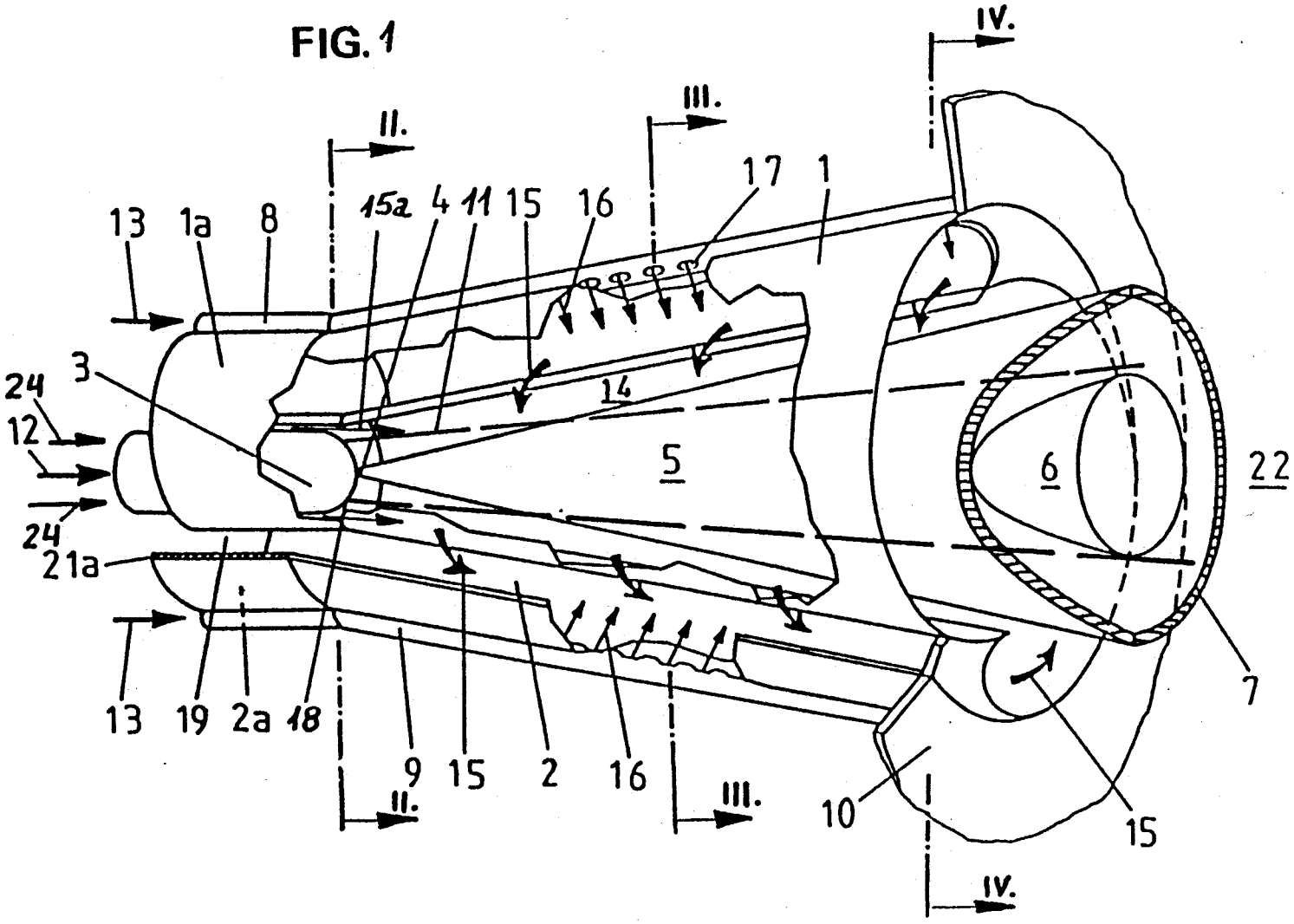
FIG. 1 shows a burner in the form of a twin-cone burner, in a perspective view, appropriately cut open.
Figure 2:
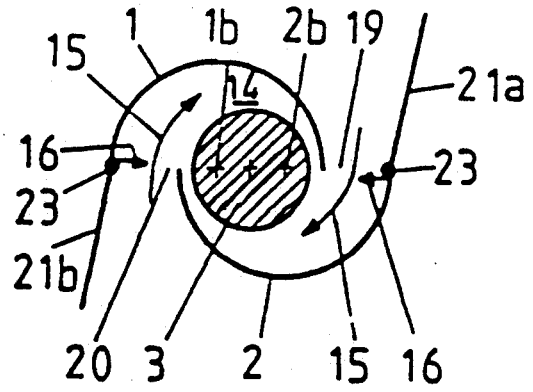
FIGS. 2, 3 and 4 show corresponding sections through the planes II—II (FIG. 2), III—III (FIG. 3) and IV—IV (FIG. 4), these sections being only a diagrammatic, simplified illustration of the twin-cone burner according to FIG. 1.
Figure 3:
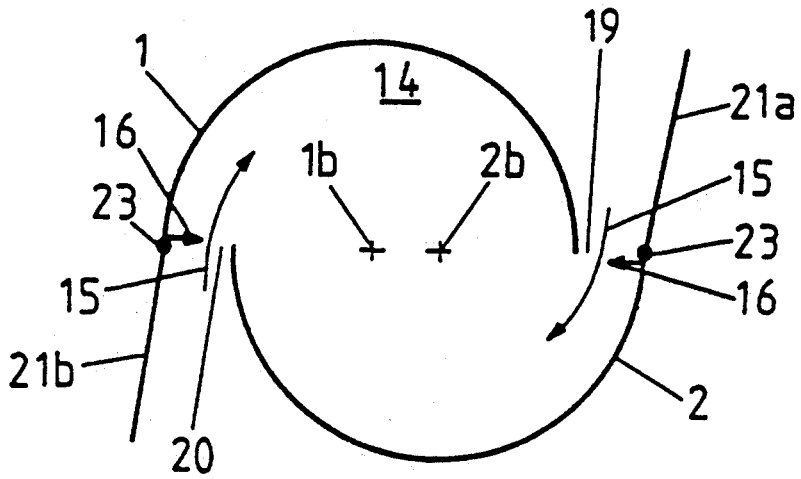
Figure 4:
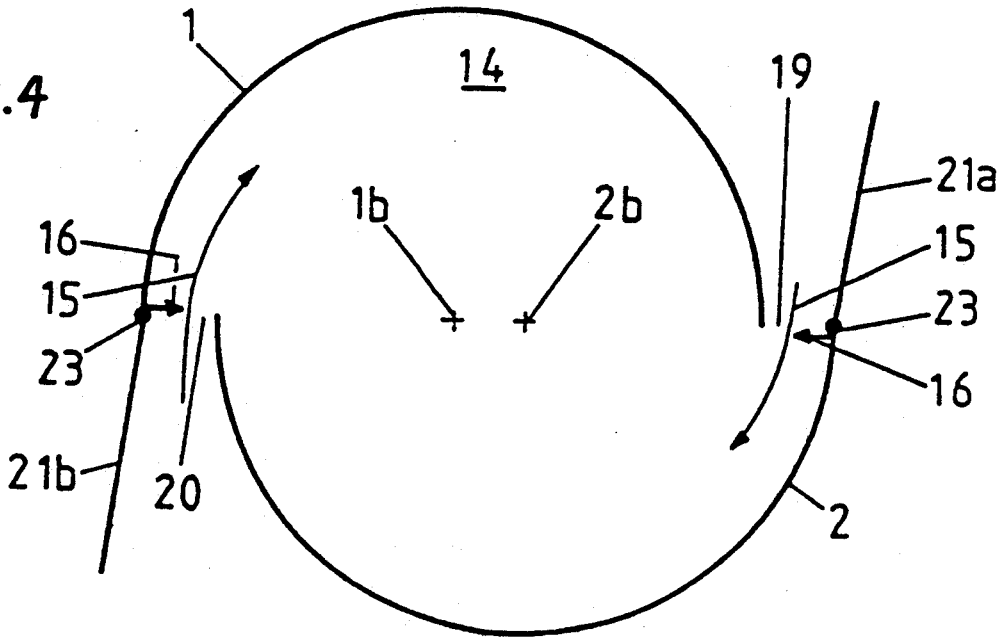

Referring now to the drawings, wherein like reference numerals designate identical or corresponding parts throughout the several views and all elements not required for direct understanding of the invention have been omitted, the direction of flow of the media being marked with arrows, it is advantageous to an improved understanding of the structure of burner A according to FIG. 1 to use, simultaneously with this figure, the individual sections marked therein, which have been set down in FIGS. 2–4. Furthermore, to avoid making FIG. 1 unnecessarily complicated, the baffles 21*a* and 21*b* shown in FIGS. 2–4 have been included only by an indication. During the description of FIG. 1 below, reference will therefore be made to the sectional FIGS. 2–4 as required.

Figure 5:
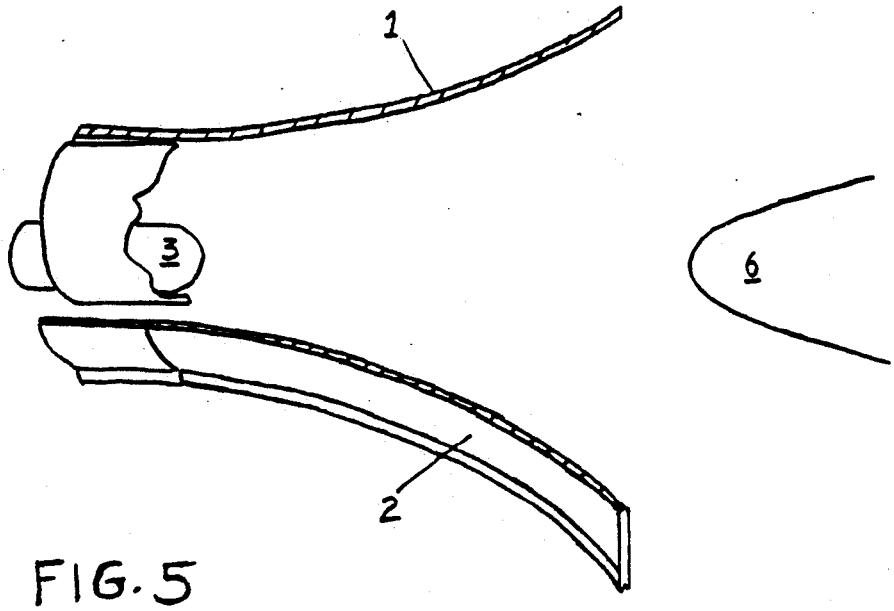
Figure 6:
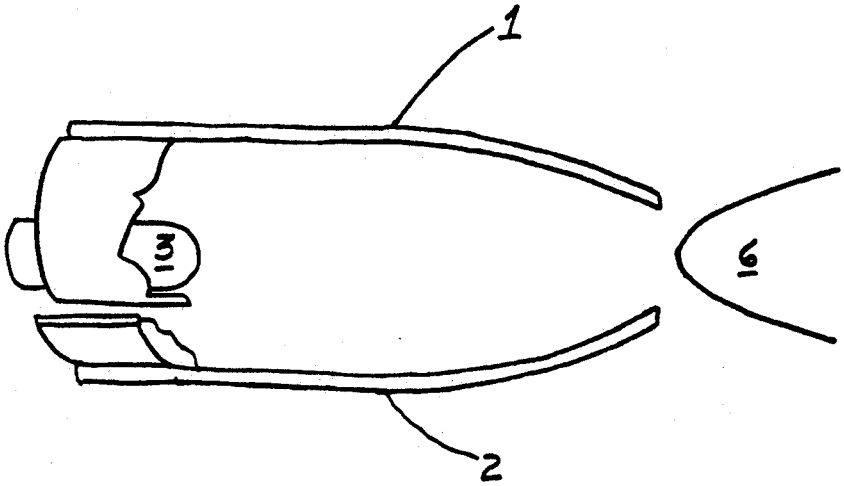

The burner A according to FIG. 1 consists of two half, hollow conical part bodies 1, 2, which extend with a radial mutual offset with respect to their longitudinal symmetry axis and are placed upon one another. The mutual offset of the particular longitudinal symmetry axes 1*b*, 2*b* creates a tangential free inlet slot 19, 20 on each of the two sides of the conical part bodies 1, 2 in an arrangement with opposite inflows (in this connection, compare FIGS. 2–4), through which slots a combustion air stream 15 flows into the interior of the burner A, i.e. into a conical cavity 14 formed by the two conical part bodies 1, 2. The conical shape of the conical part bodies 1, 2 shown has a defined fixed angle in the direction of flow. Of course, the conical part bodies 1, 2 can have a progressive or degressive cone angle in the direction of flow. FIG. 5 is a side view of the conical part bodies 1, 2 having a progressive conical inclination in the direction of flow. FIG. 6 is a side view of the conical part bodies 1, 2 illustrating a degressive conical inclination in the direction of flow. The form finally used depends essentially on the particular parameters given in the environment of the combustion. The two conical part bodies 1, 2 each have a cylindrical initial part 1*a*, 2*a*, which extends with a mutual offset analogously to the conical part bodies 1, 2, so that the tangential air inlet slots 19, 20 are present continuously over the entire length of the burner A. In this cylindrical initial part 1*a*, 2a, a nozzle 3 is accommodated whose injector 4 for a preferably liquid fuel 12 coincides with the narrowest cross-section of the conical cavity 14 formed by the two conical part bodies 1, 2. Depending on the use of the burner A in operation, a gaseous fuel or a mixture of different fuels in different physical states can also be used for the combustion. Preferably, this fuel injector 4 is placed in the center of the nozzle. In addition, the nozzle 3 has a number of further injectors 18, through which water 24 is injected into the conical cavity 14. The number of these water jets 18 and their peripheral placing on the end face of the nozzle 3 depends essentially on the size of the burner A and on its combustion characteristics. Preferably, the water jets 18 are to be provided in such a way that they form a ring opposite the fuel injector 4, the distance from the center of the nozzle 3 being discussed in more detail below. Of course, the burner A can be provided in a purely conical form, i.e. without cylindrical initial parts 1a, 2a. The two conical part bodies 1, 2 each have a fuel line 8, 9 which is provided with orifices 17 and through which a gaseous fuel 13 is supplied which in turn is admixed to the combustion air 15 flowing through the tangential air inlet slots 19, 20 into the conical cavity 14. The fuel lines 8, 9 are preferably to be provided at the end of the tangential inflow, directly before the entry into the conical cavity 14, in order to obtain the best, velocity-governed mixing 16 between the fuel 13 and the inflowing combustion air 15. Of course, mixing operation is possible with both or different fuels 12, 13. On the combustion chamber side 22, the outlet orifice of the burner A merges into a front wall 10 in which, if desired, bores not shown in the figure can be provided, in order to enable dilution air or cooling air to be introduced if required into the front part of the combustion chamber 22. The liquid fuel 12 flowing through the nozzle 3, which can be an air-assisted nozzle or a nozzle operating according to the principle of back-atomization, is injected at an acute angle into the conical cavity 14, in such a way that the conical spray pattern established in the burner outlet plane is as homogeneous as possible, which is possible and represents the optimum only if the inner walls of the conical part bodies 1, 2 are not wetted by the fuel injection 4. For this purpose, the conical burning profile 5 of the liquid is surrounded by the combustion air 15 flowing in tangentially and by a further combustion air stream 15a fed axially around the nozzle 3. In the axial direction, the concentration of the liquid fuel 12 is continuously degraded by the introduced combustion air streams 15, 15a. If gaseous fuel 13 is used via the fuel lines 8, 9, mixing with the combustion air 15 takes place, as already briefly explained above, directly in the region of the air inlet slots 19, 20, at the entry to the conical cavity 14. In connection with the injection of the liquid fuel 12, the optimum homogeneous fuel concentration over the cross-section is reached in the region where the vortex bursts open, i.e. in the region of the backflow zone 6. Ignition takes place at the tip of the backflow zone 6. It is only at this point that a stable flame front 7 can form. A flashback of the flame into the interior of the burner A, of which there is always a latent risk in known premixing sections, which is to be overcome there by means of complicated flame stabilizers, is not to be feared here. If the combustion air 15 is preheated, accelerated total vaporization of the liquid fuel 12 occurs before the point at the outlet of burner A is reached where ignition of the mixture can take place. The degree of vaporization depends of course on the size of the burner A, on the droplet size of the injected fuel and on the temperature of the combustion air streams 15, 15a. Minimized pollutant values are normally obtained if complete vaporization of the fuel before entering the combustion zone is initially ensured. The same also applies to almost stoichiometric operation, if the excess air is replaced by recirculating waste gas, in which case the combustion air consists of a mixture of frésh air and waste gases, which mixture can readily be enriched with a fuel. In this connection, it must be pointed out that the maximum permissible $NO_x$ emissions are being increasingly reduced throughout the world. Procedures for dealing with inadmissible $NO_x$ emissions by simple means are known per se: the nitrogen emissions can be drastically reduced by injecting water into the flame during the combustion of oil, gas and other fuels of high calorific value. However, the added water frequently also perturbs flame zones which, although they then produce less $NO_x$, are important for the flame stability. The consequences are frequently instabilities, such as flame pulsations and/or poor burn-out, which leads to a rapid increase in CO output. The backflow zone 6 with the flame front 7 is penetrated by a number of compact solid water jets 11 which are deployed without perturbing this sensitive stabilization zone, namely where the freshly fed fuel/air mixture is continuously ignited anew. In the interior of the flame, these water jets 11 then burst open in such a way that the water is admittedly dispersed, but in a very small region precisely where there is the potential risk of $NO_x$ emissions being formed. This avoids affecting the entire flame body, which would lead to instabilities, flame pulsations and to a poor burn-out, the consequence of which would be a rapid increase in CO output. The alignment of these water jets 11 from the nozzle 3 is to be provided in such a way that firstly the penetration of the flame front 7 is ensured and secondly it then acts in a punctiform manner on those zones where there is a potential risk of $NO_x$ emissions forming. In the design of the conical part bodies 1, 2 with respect to the cone angle and width of the tangential combustion air inlet slots 19, 20, narrow limits have to be maintained in order to ensure that the desired flow field of the combustion air with its backflow zone 6 is established in the region of the burner mouth and ensures flame stability at the latter. In general, it can be stated that a reduction in the size of the combustion air inlet slots 19, 20 shifts the backflow zone 6 further downstream, whereby, however, the mixture would then be ignited earlier. Nevertheless, it can be stated here, that the backflow zone 6 once fixed is in itself stable in position, since the spin coefficient increases in the direction of flow in the region of the conical shape of burner A. Moreover, the axial velocity can be influenced by axially feeding the combustion air stream 15a already mentioned. The design of the burner A is outstandingly suitable, at a given overall length of burner A, for varying the size of the tangential combustion air inlet slots 19, 20, by moving the conical part bodies 1, 2 towards or away from one another, whereby the distance between the two center axes 1b, 2b is reduced or increased respectively, and the size of the gap of the tangential combustion air inlet slots 19, 20 is also correspondingly varied, as can be seen particularly clearly from FIGS. 2–4. Of course, the conical part bodies 1, 2 are also displaceable relative to one another in another plane, whereby even an overlap of them can be approached. In fact, it is even possible to displace the conical part bodies 1, 2 into each other by a spiral rotary motion in opposite directions, or to displace the conical part bodies 1, 2 relative to one another by an axial motion. There is thus scope for varying the shape and size of the tangential combustion air inlet slots 19, 20 as desired, so that the burner A covers a certain operational band width without a change in its overall length.

FIGS. 2–4 show the geometrical configuration of the baffles 21*a*, 21*b*. Their function is to introduce the flow, and these baffles, corresponding to their length, extend the particular end of the conical part bodies 1, 2 in the inflow direction of the combustion air 15. The channeling of the combustion air 15 into the conical cavity 14 can be optimized by opening or closing the baffles 21*a*, 21*b* around a pivot 23 placed in the region of the entry to the cavity 14; this is necessary in particular if the original gap size of the tangential combustion air inlet slots 19, 20 is varied. Of course, the burner A can also be operated without baffles 21*a*, 21*b*, or other auxiliaries can be provided for this purpose.

Obviously, numerous modifiations and variations to the present invention are possible in the light of the above teachings. It is therefore to be understood that, within the scope of the appended claims, the invention may be practiced otherwise than as specifically described herein.

What is claimed as new and desired to be secured by letters patent of the United States is:

1. A method for minimizing $NO_x$ emissions in combustion in a premix burner of the type comprising at least two hollow bodies each having a cylindrical initial part and a conical part extending from the cylindrical part in a direction of flow, the bodies being placed upon one another to form a conical cavity, the bodies being radially offset to form two longitudinal inlet slots at opposing sides of the conical cavity for introducing combustion air into the cavity in tangential flow, a nozzle extending into the initial cylindrical part in the direction of flow with an end face at the conical part, a fuel injector port in the end face and directed in the flow direction, and at least one water injector port on the end face directed in the flow direction, each water injector port arranged to produce a compact jet of water that bursts open after a selected length of travel, the method comprising the steps of:

introducing a tangential inflow of combustion air into the conical cavity;

injecting a fuel into the conical cavity;

allowing the fuel and air to mix in the conical cavity;

igniting the fuel and air mixture to form a flame having a flame front and flame body at an outlet end of the premix burner;

introducing a compact jet of water from each water injector port through the flame front to an interior of the flame body without disturbing the flame front, wherein said jets of water are arranged to burst open in the interior of the flame body after passing through the flame front.

2. A premix burner for reduced $NO_x$ emission, comprising, in the direction of flow, at least two hollow conical part bodies which are placed upon one another and whose longitudinal symmetry axes create tangential inlet slots, which flow in opposite directions, for introducing a combustion air stream into a cavity formed by the conical part bodies, and wherein at least one nozzle for fuel injection and water feed is placed in the cavity, each nozzle having a fuel injector port located in the middle between the two longitudinal symmetry axes wherein the burner forms a flame having a flame front and a flame body at an outlet end of the burner, and each nozzle having at least one water injector port arranged to produce a compact water jet that penetrates the flame front of the burner without disturbing the flame front and bursts open in an interior of the flame body.

3. A premix burner as claimed in claim 2, wherein a plurality of water injector ports are disposed in a ring about a center of the nozzle.

4. A premix burner as claimed in claim 2, wherein further nozzles for a further fuel are disposed in the region of the tangential inlet slots.

5. A premix burner as claimed in claim 2, wherein the part bodies widen conically at a fixed angle in the direction of flow.

6. A premix burner as claimed in claim 2, wherein the part bodies have a progressive conical slope in the direction of flow.

7. A premix burner as claimed in claim 2, wherein the part bodies have a degressive conical slope in the direction of the flow.

8. A burner for minimizing $NO_x$ emissions in combustion, comprising:

at least two hollow bodies each having a cylindrical initial part and a conical part extending from the cylindrical part in a direction of flow, the bodies being placed upon one another to form a conical cavity;

the bodies being radially offset to form two longitudinal inlet slots at opposing sides of the conical cavity for introducing combustion air into the cavity in tangential flow;

a nozzle extending into the initial cylindrical part in the direction of flow with an end face at the conical part;

a fuel injector port in the end face and directed in the flow direction, whereby a flame having a flame front and a frame body is formed at an outlet end of the burner; and at least one water injector port on the end face directed in the flow direction, each water injector port arranged to produce a compact jet of water for penetrating the flame front without perturbing the flame front before bursting open in an interior of the flame body.

9. The premix burner as claimed in claim 8, wherein a plurality of water injection ports are disposed on the end face in a ring about the fuel injection port.

* * * * *